US006908167B2

(12) United States Patent
Kitami et al.

(10) Patent No.: US 6,908,167 B2
(45) Date of Patent: Jun. 21, 2005

(54) INK-JET RECORDING APPARATUS

(75) Inventors: Akiko Kitami, Hino (JP); Kazuo Asano, Hino (JP)

(73) Assignee: Konica Corporation, Tokyo (JP)

( * ) Notice: Subject to any disclaimer, the term of this patent is extended or adjusted under 35 U.S.C. 154(b) by 8 days.

(21) Appl. No.: 10/628,936

(22) Filed: Jul. 28, 2003

(65) Prior Publication Data

US 2004/0021714 A1 Feb. 5, 2004

(30) Foreign Application Priority Data

Aug. 1, 2002 (JP) ..... 2002-225332

(51) Int. Cl.[7] ..... B41J 29/38
(52) U.S. Cl. ..... 347/11
(58) Field of Search ..... 347/11, 57, 68–70

(56) References Cited

U.S. PATENT DOCUMENTS 5,625,393 A * 4/1997 Asai ..... 347/69
5,892,524 A * 4/1999 Silverbrook ..... 347/15
6,312,077 B1 * 11/2001 Araki ..... 347/11

FOREIGN PATENT DOCUMENTS

JP 55-139271 A 10/1980
JP 9-29996 A 2/1997
JP 10-081012 A 3/1998
JP 11-300966 A 11/1999
JP 2000-094669 A 4/2000
JP 2000-168103 A 6/2000

OTHER PUBLICATIONS

Sengun, Mehmet Z. "Impact of Ink Evaporation on Drop Volume and Velocity" IS&T's NIP 13: 1997 International Conference on Digital Printing Technologies, pp. 681–684.

Dr. Torpey, Peter A. "Evaporation of a Two–Component Ink Form the Nozzles of a Thermal Ink–Jet Printhead" IS&T's NIP 13: 1997 International Conference on Digital Printing Technologies, pp. 453–458.

* cited by examiner

*Primary Examiner*—Thinh Nguyen
(74) *Attorney, Agent, or Firm*—Frishauf, Holtz, Goodman & Chick, P.C.

(57) ABSTRACT

An ink-jet recording apparatus in which an electromechanical converting device that changes a volume of an ink channel of a recording head is driven to make an ink droplet to jet from a nozzle, wherein before an ink droplet jetting operation is conducted, an ink meniscus of the ink channel is vibrated finely by repeating plural times a pushing out process so that a distance corresponding to a peak of the ink meniscus pushed out from a surface of the nozzle is equal to or more than a radius of the nozzle and a process for pulling in more toward the ink channel across a repose position, while the ink is prevented from jetting from the nozzle.

22 Claims, 6 Drawing Sheets

MENISCUS FINE VIBRATING PULSE WIDTH = 4AL

MENISCUS FINE VIBRATING PULSE WIDTH = 2AL

INK-JET RECORDING APPARATUS

BACKGROUND OF THE INVENTION

The present invention relates to an ink-jet recording apparatus, and in particular, to an ink-jet recording apparatus capable of recording a high quality image at high speed.

In ink-jet recording, the smaller a diameter of an ink dot forming an image is, the more an image resolution is improved. Since a diameter of a dot depends on a size of a nozzle diameter, a nozzle diameter of an ink-jet head has been miniaturized recently. However, if the nozzle diameter is made to be too small, nozzle clogging tends to be caused. Therefore, the nozzle diameter is not made to be too small, but a position of an ink meniscus in the course of ink jetting and a jetting pressure are controlled finely so that an ink droplet that is smaller than a diameter of a nozzle for jetting may be jetted. Further, a large droplet, a medium droplet and a small droplet are jetted separately from the same nozzle, or small droplets are jetted continuously from a nozzle to be united, while they are flying, to form a large droplet, a medium droplet and a small droplet, so that images with gradation are formed. In addition, there has been made progress for ink, and waterfastness and light stability have been improved remarkably, compared with dyes, when pigment ink is used. Further, by adding polymer such as latex to ink, it has become possible to form an image that is free from feathering and color mixture on a medium that is unable to absorb ink such as, for example, a PET base. Further, by using polymer dispersing agents for pigment dispersion, ultrafine-frain ink can be dispersed stably, and pigment ink having bright color as in dyes has appeared. A combination of these technologies has made it possible to obtain an image exceeding a photograph from an ink-jet recording apparatus.

However, if a diameter of an ink droplet is made small or if pigment and polymer are added to ink, ink staying in the vicinity of a nozzle opening tends to be thickened, and even after an interruption of ink jetting for an extremely short period of time, ink jetting is impossible when jetting is started again, and a weight of jetted ink droplets, ink jetting speed and a direction of ink flying are changed, resulting in a phenomenon of remarkable decline of image quality. A nozzle opening is as extremely small as 20–40 $\mu$m, and ink hardly flow and diffuse, thus, moisture and a solvent each being in a small amount are evaporated from a nozzle opening, and viscosity of ink is increased locally in the vicinity of the nozzle opening. This interruption of jetting takes place when a head is located at a standby position for printing, and a speed of carriage is increased or decreased, and in the course of printing, depending on an image pattern. In the case of ink containing latex or polymer, even when jetting is interrupted for an extremely short period of time, for example, for a period in the order of a second, moisture and a solvent each being in an extremely small amount are evaporated from a nozzle opening and a film is formed, thus, viscosity is increased suddenly. In the case of ink containing pigment, if moisture and a solvent are evaporated from a nozzle opening in the course of interruption, aggregation takes place locally, causing a fear of increase of viscosity. If the jetted ink droplet is made to be small, a speed of the ink thickened locally at the nozzle opening to be carried away by jetting is lowered, and the ink is hardly replaced by bulk ink having low viscosity, thus, jetting failure is not solved simply. Though a small diameter of an ink droplet and addition of pigment and polymer to ink have made it possible to obtain images with high image quality and high durability, nozzle clogging tends to take place even in the case of interruption of jetting for an extremely short time, on the contrary, which requires to take measures.

With respect to evaporation of water from a nozzle opening of an ink jet head, detailed studies have already been made, and for example, it is known from Mehmet Z.Sengun, IS&T NIP 13, 1997, on page 681, that when pure ink containing 95% of water and 5% of ethylene glycol is left for 10 seconds under the 15% RH surroundings, concentration of water on the surface of nozzle opening is lowered from 95% to 20%. Under the 60% RH surroundings, concentration is lowered to 40%, and viscosity is increased suddenly in both cases. When pigment or polymer is contained, deposit of solid or formation of a film takes place in a very short time, and viscosity is capable of rising suddenly. Since ink viscosity at the nozzle opening is suddenly increased locally as stated above even in the case of interruption of jetting for an extremely short time, inability of jetting or image deterioration is caused unless jetting is conducted after viscosity is lowered.

In the case of suspension of printing for a long time, it is possible to prevent evaporation of ink component from a nozzle opening by covering the entire nozzle surface with a cap. However, capping is impossible in the period of standby for printing or in the period of interruption of jetting in printing. As one of measures for the foregoing, there is a method to stir thickened ink located in the vicinity of the nozzle opening together with bulk ink in a channel and thereby to lower ink viscosity on the nozzle opening surface, by making an ink meniscus in the nozzle to vibrate finely by driving piezoelectric material slightly to the extent not to jet ink. For example, when ink in all nozzles is made to vibrate slightly so that ink viscosity on each surface of nozzle opening may be lowered, when a head is located at the standby position outside the printing area, ink jetting is possible for the first droplet and thereafter for all nozzles. Further, it is possible to prevent thickening of ink located at the surface of the opening of a nozzle which is not jetting, by applying fine vibration drive signals in place of signals for jetting on piezoelectric material of a channel that does not jet in the course of printing in the printing area. As stated above, fine vibration includes fine vibration outside a printing area and fine vibration inside a printing area. Incidentally, when printing only a rear end portion in scanning in the case of a large-sized recording medium, even when ink viscosity is lowered at the standby position by making the ink meniscus to vibrate finely, ink viscosity on the nozzle opening is increased again before the start of jetting, because there is an interval of time before the succeeding jetting. Therefore, it is necessary to apply fine vibration again immediately before jetting. However, the timing for applying the fine vibration is difficult because stable jetting is impossible without waiting until residual vibration is brought to an end after the fine vibration is applied to the ink meniscus.

Thickening behavior varies depending on a difference between pigment ink and dye ink and on ambient temperature and humidity. It further varies depending on the state of heat generation of a head, and therefore, the optimum fine vibration needs to be applied by changing an amplitude of vibration, a frequency and the number of times of repetition for various circumstances. For example, in the case of ink that is easily thickened or of low temperature and low humidity environment, fine vibration is not applied sufficiently and ink is not stirred properly. In the case of ink that is hardly thickened or of high temperature and high humidity environment, too much fine vibration is applied, and a nozzle surface is contaminated by overflowing ink, and the direction of an ink droplet to be jetted next is deflected. Therefore, it is necessary to monitor the ambient temperature and humidity, the types of ink and temperature of a head by using various sensors, to analyze printing data sent from the head to obtain frequency of jetting ink droplets, and to control fine vibration conditions in detail and apply the optimum fine vibration, which, however, is extremely troublesome.

On the other hand, there is a method wherein fine vibration is applied outside a printing area, and then, thickened ink is spewed. In this method, viscosity on the opening section is hardly increased, and fine vibration does not need to be applied in the course of scanning, because a grain of thickened ink is discarded.

The technology to lower thickened ink viscosity by applying fine vibration on a meniscus is widely known in the field of an ink-jet recording apparatus. For example, Japanese TOKKAISHO 55-139271 discloses a technology to apply signal voltage of an amplitude or a pulse width which makes an ink droplet not to be jetted from a surface of a nozzle in the course of non-recording. Japanese TOKKAIHEI Nos. 9-29996, 10-81012 and 11-300966 and TOKKAI No. 2000-94669 disclose technologies wherein an ink meniscus of an ink-jet head employing a layer-built piezoelectric material is vibrated finely. In these technologies, a one-sided rectangular wave form or a trapezoidal waveform is used (an inclination of waveform in each of rising and falling is made to be ½ of Helmholtz resonance frequency of an ink chamber or less) to vibrate a meniscus finely. In these conventional technologies, however, it is impossible to stir thickened ink effectively. Therefore, it is necessary to set the number of times for application of fine vibrations to be great. Further, a level of each voltage for each of fine vibration, jetting and ink spewing before printing needs to be adjusted, which makes the structure of drive circuits to be complicated. Further, when an inclined form is used for a drive waveform, sensitivity for voltage is lowered more compared with an occasion of a rectangular wave, and necessary drive voltage rises and power consumption is increased, which is a problem. In addition, if the number of times of application of fine vibration drive signals is not increased, sufficient effects are not obtained, resulting in a decline of the printing speed. Therefore, effective application methods by which great effects are obtained in a short period of time are sought, by utilizing a returning travel of carriage scanning.

Japanese TOKKAI No. 2000-168103 discloses a technology wherein 80–100 pulses of drive signals are applied after discontinuance of jetting for a long period of time to push a meniscus out of a nozzle, and then, application of pulses is stopped to pull the meniscus in the nozzle for jetting. In this technology, however, since the meniscus is pushed out of the nozzle gradually when 80–100 pulses of drive signals are applied, the meniscus spreads sideways up to the surface of a nozzle plate, and it takes a considerable period of time for the meniscus to be pulled in the nozzle plate. After the meniscus is pushed out, application of pulses is stopped only to restore to the state wherein the first meniscus is formed, and sufficient effects of stirring are not obtained accordingly. Moreover, nothing is disclosed about a concrete shape of a pulse.

SUMMARY OF THE INVENTION

With the aforesaid background, an object of the invention is to provide an ink-jet recording apparatus wherein prior to jetting of ink droplets, ink in a nozzle is stirred efficiently so that a high effect of improvement of decapping characteristic may be achieved, and ink droplets are caused to jet stably. Decapping characteristic, in this case, implies an amount of a decline of an initial jetting speed caused by the so-called decapping phenomenon which means that ink is thickened by dryness of the meniscus when the nozzle surface is kept to be in the open state. Further object of the invention is make it easier to adjust a level of each voltage for each of fine vibration, jetting and ink spewing before printing.

The problems stated above can be solved by either one of following Structures 1–16.

Structure 1: An ink-jet recording apparatus in which an electromechanical converting means that changes a volume of an ink channel of a recording head is driven to make an ink droplet to jet from a nozzle, wherein before an ink drop jetting operation is conducted, an ink meniscus is vibrated finely by repeating a pushing out process plural times so that a distance corresponding to a peak of the ink meniscus pushed out from the surface of the nozzle is equal to or more than a radius of the nozzle and a process for pulling in more toward the ink channel across a repose position, while the ink is prevented from jetting from the nozzle.

Structure 2: The ink-jet recording apparatus according to the Structure 1, wherein drive signals having voltage pulse with a pulse width of $(N_1)AL$ for expanding a volume of the ink channel, a first pause period with a width of $(N_2)AL$, voltage pulse with a pulse width of $(N_3)AL$ for reducing a volume, and a second pause period with a width of $(N_4)AL$ (each of $N_1$ and $N_3$ is an integer of 2 or more, and each of $N_2$ and $N_4$ is a real number of 1 or more) are applied repeatedly plural times to the electromechanical converting device, thereby a fine vibration of the ink meniscus is conducted, under the assumption that AL represents a half of an acoustical resonance period of the ink channel.

Structure 3: The ink-jet recording apparatus according to the Structure 1, wherein drive signals having voltage pulse of rectangular wave with a pulse width of $(N_1)AL$ for expanding a volume of the ink channel, a first pause period with a width of $(N_2)AL$, voltage pulse of rectangular wave with a pulse width of $(N_3)AL$ for reducing a volume, and a second pause period with a width of $(N_4)AL$ (each of $N_1$ and $N_3$ is an integer of 2 or more, and each of $N_2$ and $N_4$ is a real number of 1 or more) are applied repeatedly plural times to the electromechanical converting device, thereby a fine vibration of the ink meniscus is conducted, under the assumption that AL represents a half of an acoustical resonance period of the ink channel.

Structure 4: The ink-jet recording apparatus according to either one of the Structures 2–3, wherein each of $N_2$ and $N_4$ is an integer of 1 or more.

Structure 5: The ink-jet recording apparatus according to either one of the Structures 2–3, wherein each of $N_1$, $N_2$, $N_3$ and $N_4$ is 4.

Structure 6: The ink-jet recording apparatus according to either one of the Structures 2–5, wherein a jetting drive voltage that makes an ink droplet to jet from a nozzle in the recording head and to record images, and a fine vibration drive voltage that vibrates finely an ink meniscus without making ink to jet from the nozzle, are the same.

Structure 7: The ink-jet recording apparatus according to the Structure 6, wherein when the recording head is outside an image recording area, an ink refreshing drive to spew ink is carried out by driving the electromechanical converting means, and each of the jetting drive voltage when the image recording is conducted, the fine vibrating drive voltage that makes the ink meniscus to vibrate finely and the ink refreshing drive voltage, is the same.

Structure 8: The ink-jet recording apparatus according to either one of the Structures 1–7, wherein a peak of fine vibration of an ink meniscus when the recording head is outside the image recording area, is greater than that of fine vibration of an ink meniscus when the recording head is on non-recording pixel in the image recording area.

Structure 9: The ink-jet recording apparatus according to either one of the Structures 1–8, wherein the electromechanical converting means forms a partition wall between adjacent ink channels, and is of piezoelectric material that deforms under a shear mode.

Structure 10: An ink-jet recording apparatus in which an electromechanical converting means that changes a volume of an ink channel of a recording head is driven to make an ink droplet to jet from a nozzle, wherein drive signals having voltage pulse with a pulse width of $(N_1)AL$ for expanding a volume of the ink channel, a first pause period with a width of $(N_2)AL$, voltage pulse with a pulse width of $(N_3)AL$ for reducing a volume, and a second pause period with a width of $(N_4)AL$ (each of $N_1$ and $N_3$ is an integer of 2 or more, and each of $N_2$ and $N_4$ is a real number of 1 or more) are applied repeatedly plural times to the electromechanical converting device, thereby a fine vibration of the ink meniscus is conducted, while the ink is prevented from jetting from the nozzle, under the assumption that AL represents a half of an acoustical resonance period of the ink channel.

Structure 11: An ink-jet recording apparatus in which an electromechanical converting means that changes a volume of an ink channel of a recording head is driven to make an ink droplet to jet from a nozzle, wherein drive signals having voltage pulse of rectangular wave with a pulse width of $(N_1)AL$ for expanding a volume of the ink channel, a first pause period with a width of $(N_2)AL$, voltage pulse of rectangular wave with a pulse width of $(N_3)AL$ for reducing a volume, and a second pause period with a width of $(N_4)AL$ (each of $N_1$ and $N_3$ is an integer of 2 or more, and each of $N_2$ and $N_4$ is a real number of 1 or more) are applied repeatedly plural times to the electromechanical converting device, thereby a fine vibration of the ink meniscus is conducted, while the ink drop is prevented from jetting from the nozzle, under the assumption that AL represents a half of an acoustical resonance period of the ink channel.

Structure 12: The ink-jet recording apparatus according to either one of the Structures 10–11, wherein each of $N_2$ and $N_4$ is an integer of 1 or more.

Structure 13: The ink-jet recording apparatus according to either one of the Structures 10–11, wherein each of $N_1$, $N_2$, $N_3$ and $N_4$ is 4.

Structure 14: The ink-jet recording apparatus according to either one of the Structures 10–13, wherein a jetting drive voltage that makes an ink droplet to jet from a nozzle in the recording head and to record images, and a fine vibration drive voltage that vibrates finely an ink meniscus without making the ink to jet from the nozzle, are the same.

Structure 15: The ink-jet recording apparatus according to the Structure 14, wherein when the recording head is outside an image recording area, an ink refreshing drive to spew ink is carried out by driving the electromechanical converting means, and each of the jetting drive voltage when the image recording is conducted, the fine vibrating drive voltage that makes the ink meniscus to vibrate finely and the ink refreshing drive voltage, is the same.

Structure 16: The ink-jet recording apparatus according to either one of the Structures 10–15, wherein the electromechanical converting means forms a partition wall between adjacent ink channels, and is of piezoelectric material that deforms under a shear mode.

The problems stated above can be solved by either one of following further preferable Structures 17–22.

Structure 17: An ink-jet recording apparatus in which an electromechanical converting means that changes a volume of an ink channel of a recording head is driven to make an ink droplet to jet from a nozzle, wherein an ink meniscus in the nozzle is pushed out from the surface of the nozzle by a distance equal to or more than a nozzle radius, and thereby, the ink meniscus is vibrated finely while the ink is prevented from flying from the nozzle.

Structure 18: The ink-jet recording apparatus according to the Structure 17, wherein the peak of the ink meniscus pushed out from the surface of the nozzle is not more than three times the nozzle radius.

Structure 19: The ink-jet recording apparatus according to the Structure 17 or 18, wherein drive signals having voltage pulse of rectangular wave with a pulse width of $(N_1)AL$ for expanding a volume of the ink channel, a pause period with a width of $(N_2)AL$ and voltage pulse of rectangular wave with a pulse width of $(N_3)AL$ for reducing a volume of the ink channel (each of $N_1$, $N_2$ and $N_3$ is an integer of 2 or more) are applied to the electromechanical converting device, under the assumption that AL represents a half of an acoustical resonance period of the ink channel.

Structure 20: The ink-jet recording apparatus according to either one of the Structures 17–19, wherein jetting drive voltage that makes an ink droplet to jet from a nozzle in the recording head, fine vibration drive voltage that vibrates finely an ink meniscus without making the ink to jet from a nozzle and ink refreshing drive voltage that spews ink outside an image recording area, are the same in terms of voltage, in the recording head.

Structure 21: The ink-jet recording apparatus according to either one of the Structures 17–20, wherein a peak of fine vibration of an ink meniscus in the occasion where the recording head is outside an image recording area is greater than that of fine vibration of an ink meniscus in the occasion where the recording head is on non-recording pixel in the image recording area.

Structure 22: The ink-jet recording apparatus according to either one of the Structures 17–21, wherein the electromechanical converting means forms a partition wall between the adjacent ink channels, and is of piezoelectric material that deforms under the shear mode.

Figure 2:
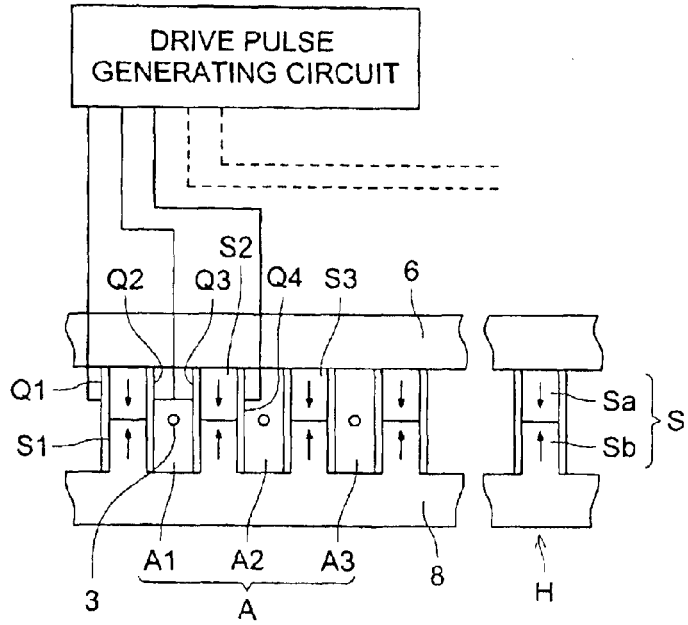
Figure 2:
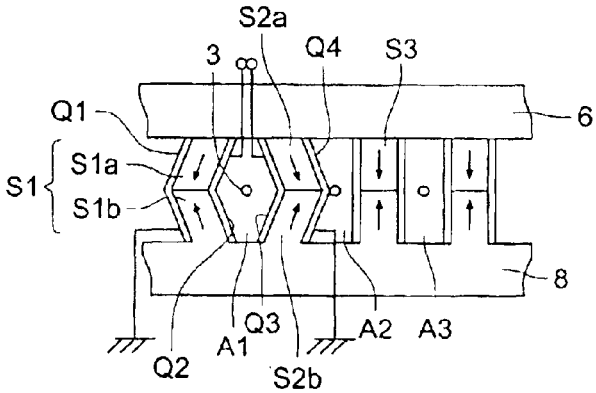
Figure 2:
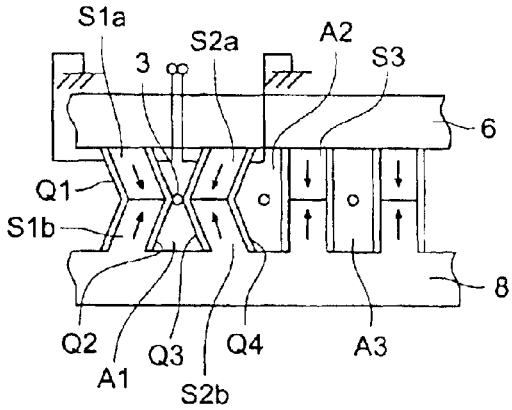

Each of FIGS. 2(*a*)–2(*c*) is a diagram showing operations of a recording head.

Figure 3:
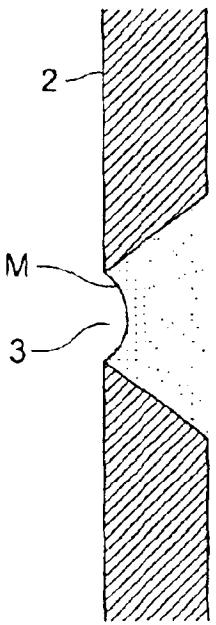
Figure 3:
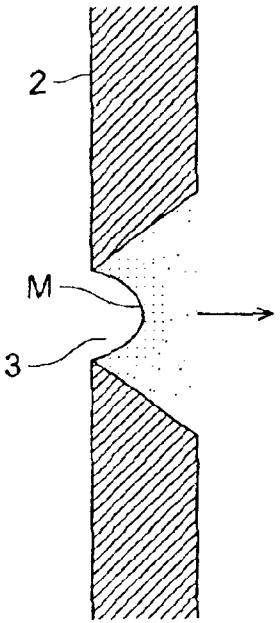
Figure 3:
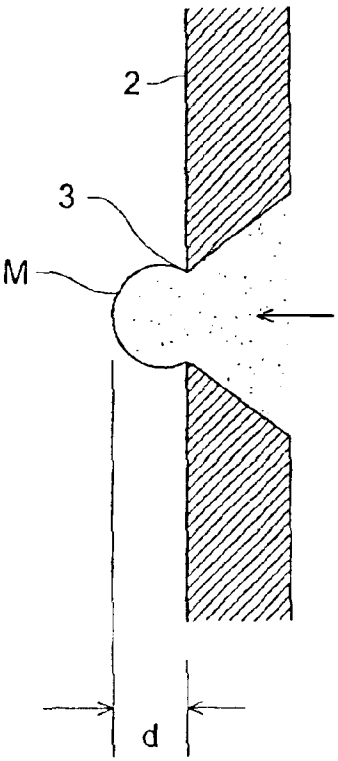
Figure 3:
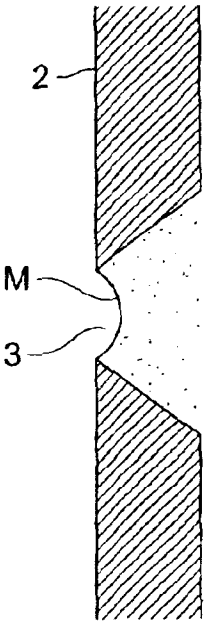

Each of FIGS. 3(*a*)–3(*d*) is an illustration showing a movement of an ink meniscus.

Figure 4:
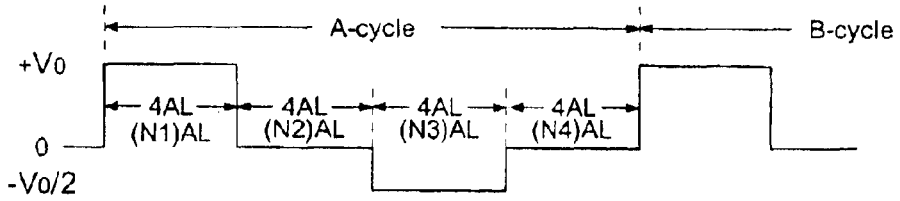

FIG. 4 is a diagram showing a preferable example of a drive signal for a ink meniscus fine vibration to be applied on a recording head.

Figure 5:
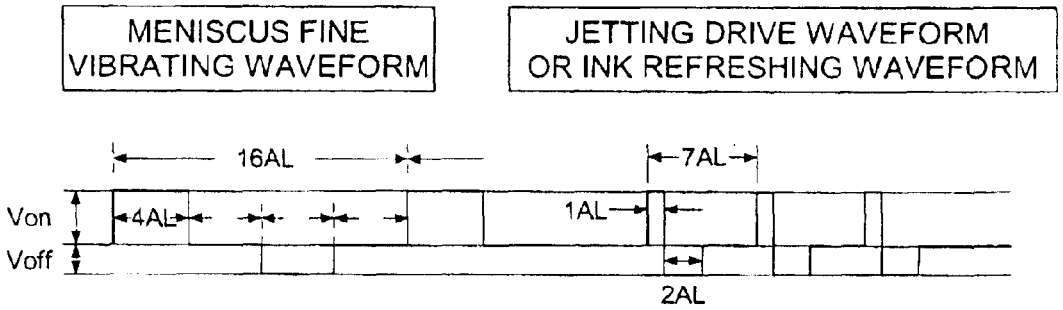

FIG. 5 is a diagram showing an example of a meniscus fine vibrating waveform, a jetting driving waveform and an ink refreshing driving waveform.

Figure 6:
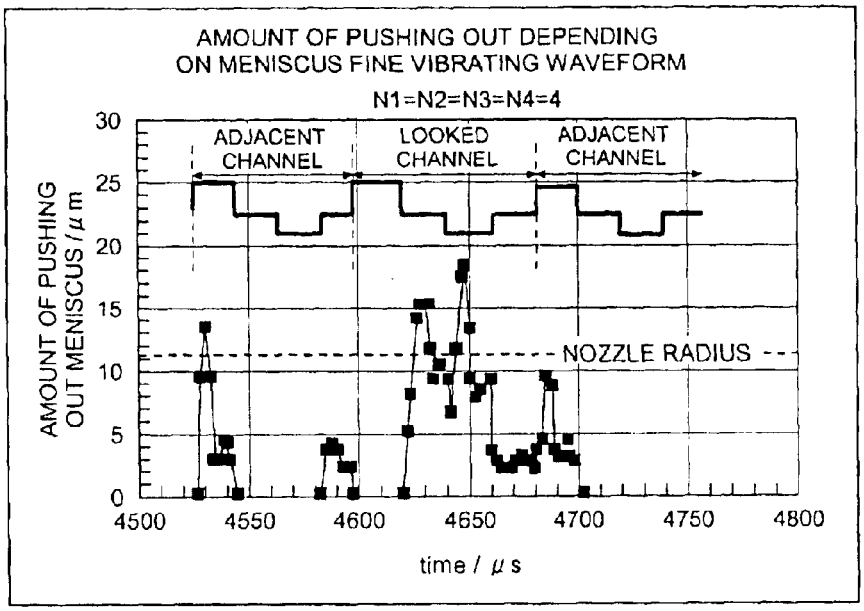

FIG. 6 is a graph showing an amount of pushing out conducted by a meniscus fine vibrating waveform.

Figure 7:
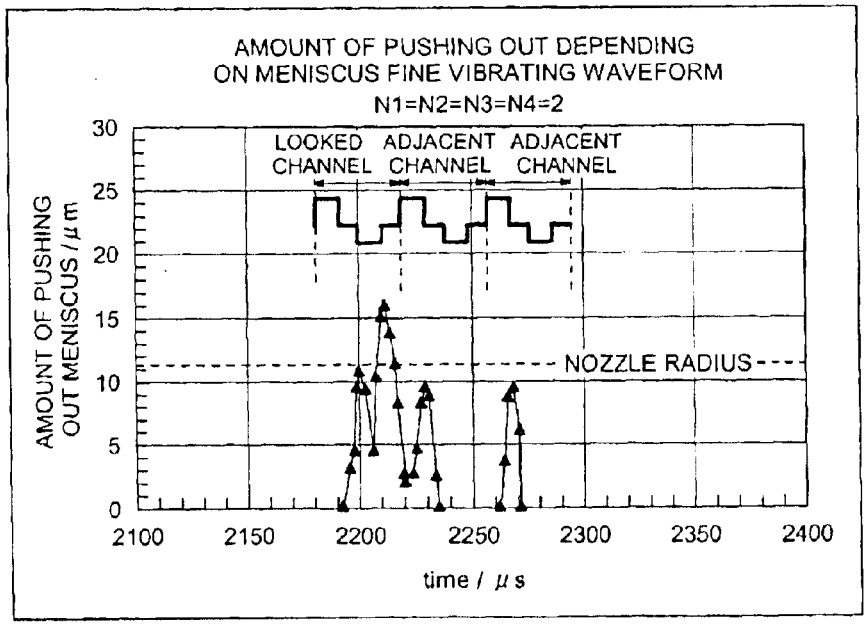

FIG. 7 is a graph showing an amount of pushing out conducted by a meniscus fine vibrating waveform.

Figure 8:
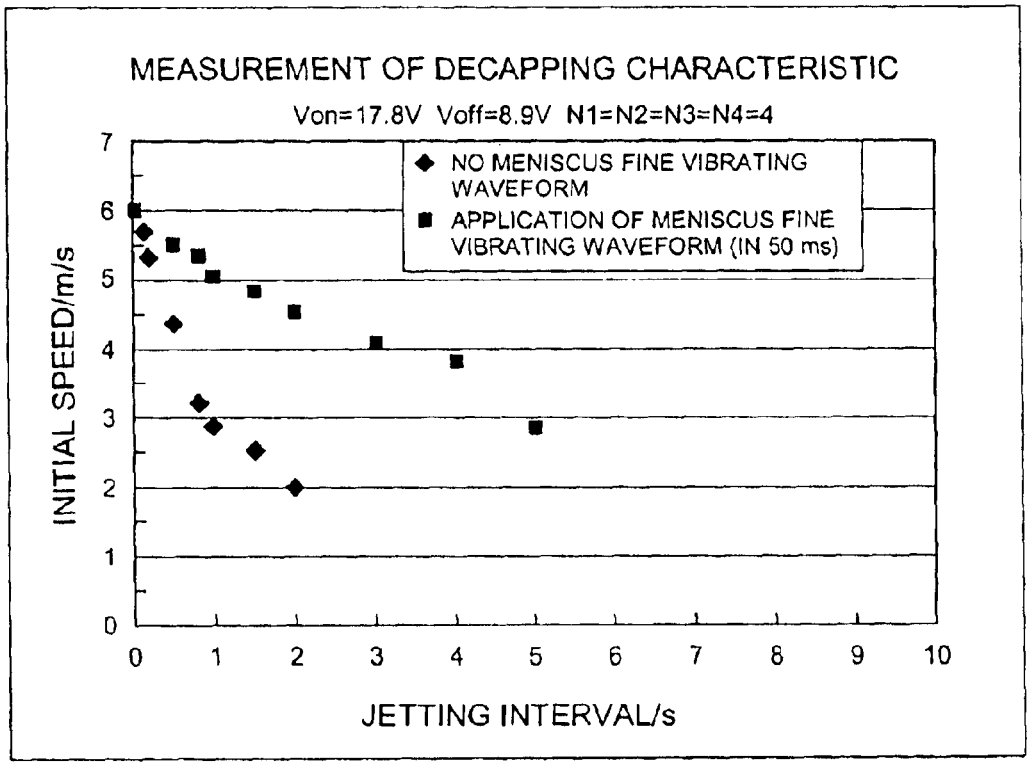

FIG. 8 is a graph showing measurement of decapping characteristic.

DETAILED DESCRIPTION OF THE PREFERRED EMBODIMENT

An embodiment of the invention will be explained as follows, referring to the drawings. Though an example for applying a rectangular wave on a recording head of a shear mode type will be given as follows for explanation, the head is not limited to the shear mode type, but any head may be used provided that the head is one for jetting ink by driving an electromechanical converting means.

Figure 1:
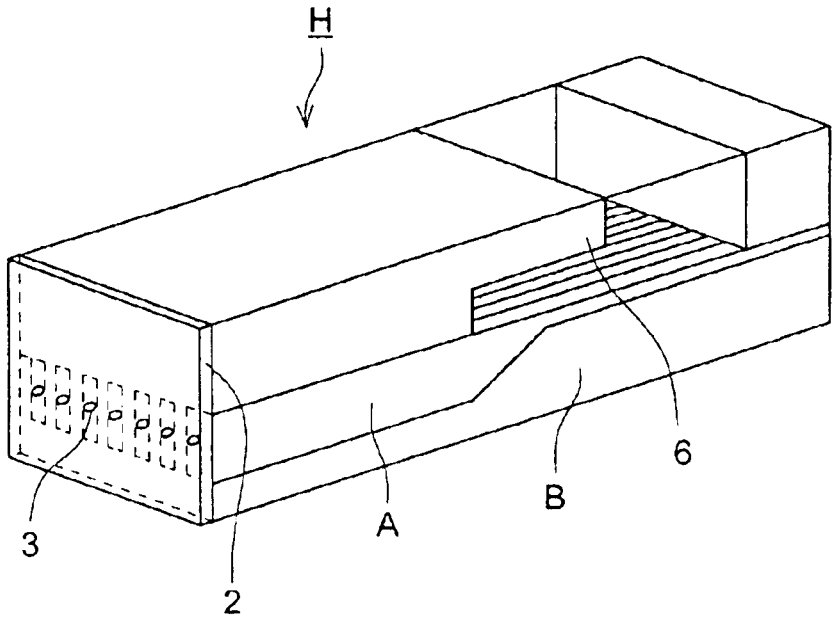
FIG. 1(*a*) is an external perspective view showing a schematic structure of a recording head of a shear mode type in an ink jet recording apparatus, and FIG. 1(*b*) is its sectional view.
Figure 1:
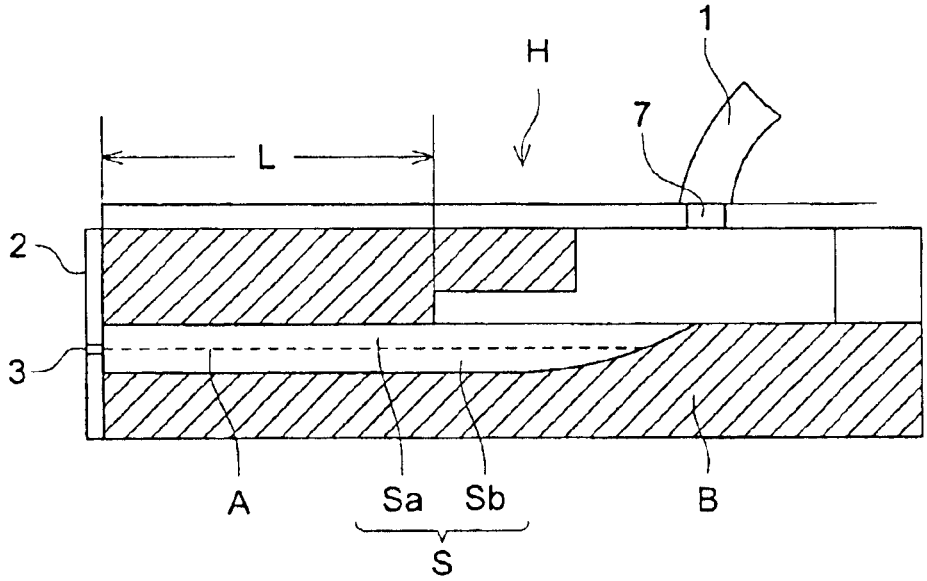

Each of FIG. 1(*a*) and FIG. 1(*b*) is a diagram showing a schematic structure of a recording head of a shear mode type in an ink jet recording apparatus, and FIG. 1(*a*) is an external perspective view and FIG. 1(*b*) is its sectional view, while, FIG. 2 are diagrams showing operations. In the diagram, the numeral 1 represents an ink tube, 2 represents a nozzle forming member, 3 represents a nozzle, S represents a partition wall serving as an electromechanical converting means, 6 represents a cover plate, 7 represents an ink inlet and 8 represents a substrate. As shown in FIG. 2, ink channel A is formed by the partition wall S, the cover plate 6 and the substrate 8.

Though FIG. 1(*b*) shows a sectional view of one ink channel A having one nozzle 3, ink channel A partitioned by partition wall S, namely, A1, A2, . . . An partitioned by S1, S2, . . . Sn+1 in large numbers serving as plural electromechanical converting means are structured as shown in FIG. 2(*a*), in recording head H that operates under the actual shear mode. One end of each of ink channels A1, A2, . . . An (hereinafter referred sometimes to as a nozzle end) is connected to nozzle 3 formed by nozzle forming member 2, and the other end (hereinafter referred sometimes to as a manifold end) is connected to an unillustrated ink tank by ink inlet 7 and ink tube 1 which constitute an ink supply section, and an ink meniscus (by ink) is formed on nozzle 3.

Each of partition walls S1, S2, . . . is constructed by each of partition walls S1*a*, S2*a*, . . . and S1*b*, S2*b*, . . . each being composed of two piezoelectric materials each being different in terms of polarization direction as shown by an arrow mark in FIGS. 2(*a*)–2(*c*), and adhesion-formed electrodes Q1 and Q2 are provided on partition wall S1 and adhesion-formed electrodes Q3 and Q4 are provided on partition wall S2. In the same way, each electrode is adhesion-formed on each partition wall, and each of electrodes Q1, Q2, . . . is connected to a drive pulse generating circuit.

In recording head H stated above, when electrodes Q1 and Q4, for example, are connected to the ground and drive pulses are applied on electrodes Q2 and Q3 under the state shown in FIG. 2(*a*), an electric field in the direction perpendicular to the polarization direction of piezoelectric materials constituting partition walls S1 and S2 is generated, then, shear deformation is caused on the joining surface of partition walls for both partition walls S1*a* and S1*b*, and shear deformation is caused on the joining surface of partition walls for both partition walls S2*a* and S2*b* in the opposite direction in the same way, thus, partition walls S1*a* and S1*b* and partition walls S2*a* and S2*b* are deformed toward the outside each other, and thereby, a volume of ink channel A1 is enlarged to generate negative pressure therein, and ink flows in the ink channel. Simultaneously, pressure starts rising at a manifold end and a nozzle end, and an acoustic wave is transmitted toward the ink channel center to arrive at the opposite end after the progress of 1AL, thus, the pressure in the ink channel becomes positive.

Incidentally, AL is a half of an acoustical resonance period of the ink channel. Further, the pulse width is defined to be a period of time required to advance from the point of 10% of voltage in the rise of voltage to the point of 10% in the fall of voltage. This AL is obtained as a pulse width that makes the flying speed of an ink droplet to be maximum when the speed of an ink droplet that is jetted when a rectangular wave is applied on partition wall S representing an electromechanical means is measured, and a pulse width of the rectangular wave is changed under the constant voltage value of the rectangular wave.

Further, in this case, the rectangular wave is a waveform wherein each of the rise time from 10% to 90% of voltage and the fall time from 90% to 10% of voltage is preferably within ½ of AL, more preferably within ¼ of AL.

Each of acoustic waves arriving respectively at a nozzle end and a manifold end is reflected there to become negative pressure wave whose phase is reversed by 180°, and is propagated toward the center of the ink channel. After further progress of 1AL, negative pressure wave arrives respectively at the other end, and the pressure in the ink channel becomes negative. In this way, the pressure wave generated by the movement of the partition walls repeat reversing of the pressure at intervals of AL period. Since the nozzle end is connected with air whose acoustic impedance is small, reflection is almost 100%, but on the manifold end, reflection is partial in accordance with a ratio of a cross-sectional area of the ink channel to a cross-sectional area of a manifold, thus, the pressure is attenuated gradually.

When electric potential is returned to zero after the lapse of 1AL from application of the first drive pulse, partition walls S1 and S2 return from the swelled positions to neutral positions shown in FIG. 2(*a*), and high pressure is applied on ink. Then, when a volume of ink channel A1 is reduced by applying drive pulses so that a group of partition walls S1*a*and S1*b* and a group of partition walls S2*a* and S2*b* may be deformed in the opposite directions to approach each other, there is generated positive pressure in ink channel A1. Owing to this, an ink meniscus formed in nozzle 3 by a part of ink filled in ink channel A1 is changed in the direction to be pushed out of nozzle 3. When this positive pressure becomes great enough to jet an ink droplet from nozzle 3, the ink droplet is jetted from the nozzle 3. If electric potential is returned to zero after keeping the aforementioned state for a period of 2AL so that partition walls S1 and S2 are returned to their neutral positions from the contracted positions, the residual pressure wave is canceled to be ready for the succeeding jetting of an ink droplet. When forming eight gradations by jetting 0–7 droplets continuously and by uniting them while they are flying or on a recording medium, this is repeated 0–7 times in accordance with image data. Further, each ink channel operates in the same way as the foregoing through applying of drive pulses.

When partition walls S1 and S2 of ink channel A1 operate to be deformed as stated above, adjacent channel A2 is influenced, and therefore, there is usually conducted the so-called three-cycle jetting to jet ink by dividing ink channels into three groups at an interval of three channels. For example, there is employed a method wherein A1, A4 and A7 are driven by the pulse in the same cycle, and then, A2, A5 and A8 are driven in the following cycle.

In the recording head of this kind, the invention is characterized in that, prior to ink droplet jetting, an ink meniscus in nozzle 3 is vibrated finely without jetting from the surface of the nozzle 3 by repeating plural times a process of pushing out so that the peak of pushing out may become equal to a radius of a nozzle or more and a process of pulling in toward the ink channel across the repose position before an ink droplet jetting operation is conducted, and thereby, the ink meniscus is vibrated finely.

In this case, "prior to ink droplet jetting" means the time of a range wherein an effect is observed in an improvement of decapping characteristic in jetting of ink droplets that is vibrated finely.

Further, ink droplets jetting includes jetting for image recording and spewing outside an image recording area for ink refreshing.

The peak of pushing out implies the greatest value of an amount of pushing out of ink meniscus from a nozzle surface in one cycle of a meniscus pushing out process.

If an ink meniscus is pushed out by an amount of a radius of nozzle 3 or more, even if the pressure is eliminated, the ink is not sucked in nozzle 3 as is clear from Laplace's law, which requires negative pressure to absorb the ink in. Therefore, if the ink meniscus is pushed out by an amount exceeding a nozzle radius in the course of jetting, it takes time to return the ink meniscus to its repose position, and therefore, the ink meniscus is not pushed out usually by an amount exceeding a nozzle radius. In the invention, if an ink meniscus is pushed out by an amount exceeding a nozzle radius, the ink meniscus is sucked further than the repose position in the following cycle, and thereby, ink in nozzle 3 can surely be stirred. Incidentally, although only spewing of thickened ink is effective if the purpose is only improving the decapping characteristic, there is a fear that a part of ink stays on the surface of nozzle 3 to contaminate nozzle forming member 2, because the jetting speed of the thickened ink is low when it is spewed. If the thickened ink is spewed after lowering its viscosity by applying fine vibration to the ink meniscus as stated above for preventing the aforementioned problem, the jetting speed is increased and the problem that ink stays on nozzle forming member 2 is eliminated.

Movements of ink meniscus M in the aforesaid occasion are shown in FIGS. 3(*a*)–3(*d*). FIG. 3(*a*) shows a state of repose position wherein drive pulses are not applied on a recording head. When partition walls are deformed toward the outside as shown in FIG. 2(*b*) by applying drive pulses on the partition walls from the aforesaid state of repose, and a volume of the ink channel between the partition walls is expanded accordingly, ink is drawn back into the ink channel by the negative pressure generated in the ink channel to retract ink meniscus M from the repose position of nozzle 3 as shown in FIG. 3(*b*).

Incidentally, in this case, the repose position is a position of forming a meniscus under the condition that driving pulses are not applied, and that position is slightly pulled in a nozzle because the pressure in an ink channel is usually established to be negative.

Further, if a volume of the ink channel is reduced by applying drive pulses so that the partition walls may be deformed in the direction opposite to the foregoing, as shown in FIG. 2(*c*), ink is pushed out of the nozzle 3 by positive pressure generated in the ink channel, as shown in FIG. 3(*c*). In this case, ink meniscus M is advanced to the extent not to fly an ink droplet from nozzle 3, so that the peak d from the surface of the nozzle 3 for the ink meniscus M may become an amount equal to or more than a radius of the nozzle 3, in the invention. In this case, it does not happen that the ink meniscus wets and spreads substantially on the surface of a nozzle forming member on the ink jetting side.

Incidentally, an opening of the nozzle takes various shapes such as an oval shape and others without being limited to complete round, and a radius of a nozzle in the invention means a half of the longest diameter of nozzle 3 on its tip (surface of nozzle forming member 2) side.

After that, when applying of drive pulses is stopped, the partition walls return to the state shown in FIG. 2(*a*). In this case, the ink meniscus M is drawn back into the ink channel again, and is restored to the repose position as shown in FIG. 3(*d*).

By repeating vibration of ink meniscus M so that the ink meniscus M in nozzle 3 is vibrated finely from the surface of the nozzle 3 by repeating plural times a process of pushing out so that the peak of pushing out may become equal to a radius of a nozzle or more and a process of pulling in more toward the ink channel across the repose position before an ink droplet jetting operation is conducted, as stated above, movements of ink between the neighborhood of the nozzle 3 and the inside of the ink channel are promoted, thus, ink can be stirred surely, a difference of ink viscosity between the nozzle and the ink channel is controlled, and decapping characteristic is improved.

It is preferable that the number of times for repeating plural times is 10 times or more. If this number is too small, an effect for improvement of decapping characteristic grows small.

Incidentally, a peak d of ink meniscus M that is pushed out from the surface of nozzle 3 is made to be three times a radius of the nozzle or less. When the peak of pushing out d of ink meniscus M exceeds three times a radius of the nozzle, an ink droplet jets from the nozzle 3 and causes occurrence of erroneous jetting of ink.

Further, it is preferable that the a peak of pushing out of fine vibration of ink meniscus M in the case when recording head H is present outside an image recording area is greater than a peak of pushing out of fine vibration of ink meniscus M in the case when recording head H is present on a non-recording pixel in the image recording area. The basis of this is as follows. In the image recording area, the peak of pushing out of fine vibration of ink meniscus M needs to be controlled because great vibration of ink meniscus M has an influence on jetting. Outside the image recording area, however, there is no influence on jetting. Therefore, if ink meniscus M is fine vibrated greatly, ink in nozzle 3 can be stirred efficiently, and higher effect of improvement for decapping characteristic can be obtained.

The inside of the image recording area, in this case, is an area where image data are supplied to a recording head, and ink is jetted from a nozzle of a recording head based on the image data for recording, and when recording on the entire surface of a sheet of paper in A4 size representing a recording medium, for example, the entire surface of a sheet of paper in A4 size is the image recording area.

The outside of the image recording area is an area other than the image recording area where image data are not supplied to the recording head basically, and ink jetting from all nozzles based on image data is not conducted. Further, a non-recording pixel is a pixel that does not jet ink in the image recording area.

A peak of pushing out of ink meniscus M pushed out from the surface of nozzle 3 is adjusted by changing amplitude of voltage, a pause period or a pulse width of drive signals applied on partition wall S. Now, a preferable example of a drive signal that is applied on recording head H for fine vibrating the ink meniscus M is shown in FIG. 4. As shown in FIG. 4, the drive signal has a voltage pulse with a rectangular wave having a pulse width of $(N_1)$AL for expanding a volume of an ink channel for a partition wall representing an electromechanical means when AL (unit: $\mu$s) represents a half of acoustical resonance period of the ink channel, a first pause period having a width of $(N_2)$AL, a voltage pulse with a rectangular wave having a pulse width of $(N_3)$AL for reducing a volume of an ink channel and a second pause period having a width of $(n_4)$ AL. Incidentally, each of $N_1$ and $N_3$ is an integer of 2 or higher, and each of $N_2$ and $N_4$ is a real number of 1 or more.

It is preferable that each of $N_1$, $N_2$, $N_3$ and $N_4$ is not more than 20, and it is more preferable to be not more than 6. When the pulse width is too long, a driving cycle turns out to be long, which is not preferable. It is further preferable that each of $N_2$ and $N_4$ is an integer of 1 or more.

First, a pulse of positive voltage $+V_D$ (hereinafter referred sometimes to as $V_{on}$) that expands a volume of ink channel A as shown in FIG. 2(*b*) from the state shown in FIG. 2(*a*), and generates negative pressure inside the ink channel A is applied on electrodes Q2 and Q3. In this case, positive voltage +VD is applied with a pulse width of 4AL under the condition of $N_1$=4. Then, after a passage of this 4AL, the pulse to be applied on the electrodes Q2 and Q3 is made to be 0V to return to the state shown in FIG. 2(*a*) represented by a first pause period. In this case, there is provided a pause period having a width of 4AL under the condition of $N_2$=4. Further, after this first pause period, a pulse of negative voltage that generates positive pressure inside ink channel A as shown in FIG. 2(*c*) is applied on the electrodes Q2 and Q3. In the present embodiment, this negative voltage (hereinafter referred sometimes to as $V_{off}$) is made to be a pulse of $-V_D/2$ that is a half of the positive voltage $+V_D$ in terms of an absolute value. In this case, negative voltage $-V_D/2$ is applied-with a pulse width of 4AL under the condition of $N_3$=4. Further, a second pause period is provided by returning to the state of FIG. 2(*a*). In this case, there is provided the second pause period having a width of 4AL under the condition of $N_4$=4.

By applying plural times repeatedly a pulse with a rectangular wave composed of $(N_1)$AL, $(N_2)$AL, $(N_3)$AL and $(N_4)$AL as a drive signal, it is possible to vibrate finely ink meniscus M efficiently as shown in FIGS. 3(*a*)–3(*d*). Incidentally, $N_1$ and $N_3$ may be any number provided that the number is an integer of 2 or more, and $N_2$ may be any number provided that the number is a real number of 1 or more. $N_1$, $N_2$, $N_3$ and $N_4$ do not need to be the same, and each of them may take a different value. However, if each of $N_1$, $N_2$, $N_3$ and $N_4$ is made to be 4 as in the aforementioned embodiment, the higher effect of improvement for the decapping characteristic is obtained and thus preferable.

When a rectangular wave is used for a drive waveform having a fine vibration of the ink meniscus as mentioned above, efficiency of fine vibration of ink meniscus M is excellent and it is possible to vibrate it finely with lower drive voltage, compared with a method to use an inclined waveform such as a trapezoid waveform, thus preferable. Further, it is prevented that an ink droplet is jetted from nozzle 3 by the fine vibration, because a pulse width of each of $N_1$ and $N_3$ is made to be a length of 2AL or more, and each of the first pause period of $N_2$ and the second pause period of $N_4$ is made to be a length of 1AL or more.

Incidentally, using two power supplies including positive one and negative one causes cost increase for drive circuits. For that problem, the same effect can be obtained by a method to use only positive power supply and to apply positive voltage on electrodes of an ink channel that is next to the ink channel for jetting when negative voltage is needed. When jetting, positive voltage pulse with a width of 1AL and negative voltage pulse with a width of 2AL that follows the former are applied on the electrodes on both sides of the jetting channel by making both adjacent channels for the jetting channel to be at zero voltage, as shown in FIGS. 2(*a*)–2(*c*). However, in place of applying negative voltage pulse having a width of 2AL, it is possible to apply positive voltage pulse having a width of 2AL on the electrodes of the channels on both sides. Namely, positive voltage pulse having a width of 1AL is applied on the electrodes of a jetting channel, and positive voltage pulse having 2AL that is delayed by 1AL is applied on the electrodes of a non-jetting channel. In the case of a shear mode head wherein walls on both sides of an ink channel are expanded and contracted to jet ink, when ink is jetted from one ink channel, ink channels on both sides of that ink channel cannot jet ink simultaneously. Accordingly, there is conducted the so-called three-cycle jetting in which ink channels are divided into three groups at an interval of three channels. For example, in jetting ink by dividing channels into three channels of A, B and C, when channel B is jetting, channels A and C do not jet, and therefore, positive voltage pulse having 2AL is applied on the electrodes of non-jetting channels of A and C in place of applying negative voltage pulse with 2AL on the electrodes of channel B.

A ratio of positive voltage $(V_{on})$ to negative voltage $(V_{off})$ may also be 1:1 without being limited to 2:1. The former has an effect to make a droplet to be small and to stabilize jetting in the course of ink jetting, while when optimum voltage for jetting is established, the latter has an effect that an amount of pushing out of an ink meniscus is greater when the fine vibration is applied.

In the invention, drive signals applied on recording head H include ink refreshing drive signals in addition to jetting drive signals for making an ink droplet to jet from nozzle 3 and fine vibration drive signals for vibrating finely the ink meniscus without making an ink to jet from nozzle 3, as described above. This ink refreshing drive signal is a signal for conducting refreshing operations to spew ink in the vicinity of nozzle 3 forcibly, before ink viscosity in the vicinity of nozzle 3 and ink viscosity in ink channel A are enhanced to the level to cause jetting trouble because ink jetting is not conducted continuously, even when movements of ink between the neighborhood of the nozzle 3 and the inside of the ink channel are promoted. This refreshing operations are conducted outside an image recording area.

FIG. 5 shows fine vibration drive signals for vibrating finely an ink meniscus, jetting drive signals for making an ink droplet to jet from nozzle 3 and ink refreshing drive signals. In this case, the fine vibration drive signals which are the same as the drive signals shown in FIG. 4 are exemplified, and the jetting drive signals and ink refreshing drive signals are made to be the same drive signals. Though the ink refreshing drive signals usually employ voltage which is higher than that for the jetting drive signals because ink is thickened, it is possible to set both ink refreshing drive signals and jetting drive signals to be at the same voltage by applying fine vibration signals immediately before ink refreshing. When the aforementioned signals are used for fine vibration drive signals, an ink meniscus can be fine vibrated effectively without causing erroneous jetting, at the same electric potential as that for the jetting drive signals.

In this case, positive voltage $(V_{on})$ is applied with a pulse width of 1AL, then, negative voltage $(V_{off})$ is applied with a pulse width of 2AL, and a pause period at 0V with a pulse width of 4AL is provided to make the jetting drive signals and the ink refreshing drive signals to be drive signals with a period of 7AL, and fine vibration drive voltage, jetting drive voltage and ink refreshing drive voltage are made to be the same voltage. Owing to this, the number of power sources for driving is low and thereby, cost of circuits can be reduced, and driving circuits can be designed with simple digital circuits because entire driving waveforms can be constructed only by rectangular pulses.

An electromechanical converting means in the invention may be of any structure, provided that the means gives to a recording head a function to change a volume of an ink channel. However, when the electromechanical converting means forms a partition wall between ink channels and is of a piezoelectric material which deforms under the shear mode, as stated above, it is possible to utilize the drive waveform with a rectangular wave effectively, thus drive voltage may be lowered to permit more effective drive, which is preferable.

EXAMPLE 1

Effects of the invention will be exemplified as follows, based on Examples.

<Evaluation of the Peak of Push-out of Meniscus>

Ink channels of the recording head of a shear mode type shown in FIGS. 1(*a*) and 1(*b*) (number of nozzles: 256, diameter of nozzle: 23 μm) are divided into three groups, and three-cycle driving was conducted under the following conditions by the use of drive signals with rectangular waveform shown in FIG. 4.

An amount of pushing out of ink meniscus from a nozzle was measured by the use of Digital Microscope "VH-6300" made bY KEYENCE Co., and results of the measurement are shown in FIG. 6. With regard to an amount of pushing out, an amount of projection of an ink meniscus from a nozzle end positioned mostly at the central portion of the nozzle was measured in the direction that is mostly perpendicular to a nozzle forming member (d in FIG. 3(*c*)).

Incidentally, a graph in the lower step in the drawing shows an amount of pushing out for an ink meniscus of its own channel corresponding to the moment of applying drive signals described in the upper step.

(Conditions)

Ink: Aqueous ink (Viscosity: 4.1 mPa·s, Surface tension: 35 mN/m at 25° C.);

Applied voltage: $V_{on}$=14.5 V ($V_{on}/V_{off}$=2/1);

Ambient conditions: Temperature 25° C., Humidity 50% RH;

Drive pulse width: $N_1=N_3=4$; and

Pause period: $N_2=N_4=4$.

As is shown in the drawing, it is understood that the ink meniscus is pushed out so that a peak of pushing out from a surface of the nozzle is equal to or more a radius of the nozzle, through application of ink meniscus fine vibrating waveform shown in FIG. 4.

When a voltage pulse having a pulse width of ($N_1$) AL for expanding a volume of the ink channel was applied on a looked channel, the ink meniscus was at the position standing back from the repose position, which is not shown in the drawing. When a fine vibration waveform is applied repeatedly on a three-cycle drive basis, 48 AL periods of fine vibrations of meniscus are repeated as shown in FIG. 6.

It is further understood that that the ink meniscus is pushed out so that a peak of pushing out from a surface of the nozzle is equal to or more a radius of the nozzle, by an amount equal to or more than a radius of the nozzle, as shown in FIG. 7 even in the case of drive pulse width: $N_1=N_3=2$, and pause period: $N_2=N_4=2$.

When a voltage pulse having a pulse width of ($N_1$) AL for expanding a volume of the ink channel was applied on a looked channel, the ink meniscus was at the position standing back from the repose position.

<Evaluation 1 of Decapping Characteristic>

Ink channels of the recording head of a shear mode type which is the same as one in "Evaluation of the peak of push-out" were divided into three groups, and three-cycle driving was conducted under the following conditions by the use of drive signals with rectangular waveform shown in FIG. 5. Applied voltage of meniscus fine vibrating waveform was changed as shown in Table 1, and an amount of ink meniscus pushed out of the nozzle in that case was measured by the use of digital microscope "VH-6300" made by KEYENCE Co., to evaluate an effect of improvement for decapping characteristic.

With respect to the evaluation of the effect of improvement for decapping characteristic, a decline rate of the initial speed for jetting ink was measured by the following method while widening a jetting interval, and the decline rate was evaluated based on the following standards. The results of the evaluation are shown in Table 1.

(Conditions)

Drive pulse width of meniscus fine vibrating waveform: $N_1=N_3=4$;

Pause period of meniscus fine vibrating waveform: $N_2=N_4=4$, incidentally, as for comparative sample in Table 1, $V_{on}$ only is applied as a meniscus fine vibrating waveform;

Meniscus fine vibrating waveform voltage: $V_{on}/V_{off}$=1/1;

Jetting voltage: 12 V ($V_{on}/V_{off}$=1/1);

Meniscus fine vibrating waveform period: 16AL (76.8 μs)/cycle; and

Ink: Aqueous ink (Viscosity: 4.1 mPa·s, Surface tension: 35 mN/m at 25° C.).

(Measurement Method)

A meniscus fine vibrating waveform corresponding to voltage value in Table 1 was applied repeatedly 217 times for a period of 50 ms from the moment of 220 ms before the start of ink jetting, and the initial jetting speed was measured. A rate of decline for jetting speed for jetting interval of 2s from the speed under the condition of jetting interval of 16.7 ms. Incidentally, jetting voltage was fixed to 12 V.

(Evaluation Ranking)

A: Decline rate of less than 10%

B: Decline rate of not less than 10% and less than 30%

C: Decline rate of not less than 30% and less than 50%

D: Decline rate of 50% or more

E: Unevaluated because of erroneous jetting

Results shown in Table 1 for present Examples 1 to 5 indicate that when the peak of pushing out of an ink meniscus is equal to an amount of a nozzle radius (11.5 μm) or more, it is effective for an improvement of decapping characteristic.

In Comparative Example 1, on the other hand, the decapping characteristic was inferior because a peak of pushing out was less than a nozzle radius, and in Comparative Example 2, erroneous jetting of ink droplets was caused because a peak of pushing out was greater than three times the nozzle radius. Incidentally, in this case, the optimum meniscus fine vibrating waveform voltage was 12 V.

TABLE 1

| | Voltage to be applied | Peak of push-out of meniscus | Effect of improvement for decapping charac-teristic | Erroneous jetting caused by excessive push-out of meniscus |
|---|---|---|---|---|
| Comparative example 1 | 11 V | 8 μm | D | No |
| Present example 1 | 9 V | 12 μm | C | No |
| Present example 2 | 10 V | 16 μm | B | No |
| Present example 3 | 11 V | 20 μm | B | No |
| Present example 4 | 12 V | 26 μm | A | No |
| Present example 5 | 13 V | 35 μm | B | No |
| Comparative example 2 | 14 V | >40 μm | E | Yes |

<Evaluation 2 of Decapping Characteristic>

Three-cycle driving was conducted under the following conditions, by the use of a recording head identical to that in "Evaluation of the peak of push-out" and drive signals with rectangular waveform shown in FIG. 5. Pulse widths were changed as shown in Table 2, and a peak of ink meniscus pushed out of the nozzle in that case was measured in the same way as in "Evaluation 1 of decapping characteristic", and an effect of improvement for the decapping characteristic was evaluated based on the same standard as "Evaluation 1 of decapping characteristic". Results of the evaluation are shown in Table 2.

(Conditions)

Drive pulse width and pause period: $N_1=N_2=N_3=N_4$;

Applied voltage: 12 V ($V_{on}/V_{off}=1/1$);

Applied period: (Fine vibrating pulse width×4)/cycle; and

Ink: Aqueous ink (Viscosity: 4.1 mPa·s, Surface tension: 35 mN/m at 25° C.).

TABLE 2

| | Meniscus fine vibrating waveform $N_1 = N_2 = N_3 = N_4$ | Peak of push-out meniscus | Effect of improvement for decapping characteristic | Erroneous jetting caused by excessive push-out of meniscus |
|---|---|---|---|---|
| Comparative example 3 | 1 AL | >40 μm | — | Yes |
| Present example 6 | 2 AL | 20 μm | B | No |
| Present example 7 | 3 AL | 21 μm | B | No |
| Present example 8 | 4 AL | 26 μm | A | No |
| Present example 9 | 5 AL | 20 μm | B | No |
| Present example 10 | 6 AL | 17 μm | B | No |
| Present example 11 | 10 AL | 14 μm | C | No |
| Present example 12 | 15 AL | 14 μm | C | No |

Table 2 indicates that a fine vibrating waveform pulse width for $N_1$ and $N_3$ of 2AL or more makes it possible to obtain a peak of push-out of an appropriate ink meniscus vibrating amplitude, and it is effective for improvement of decapping characteristic.

<Evaluation 3 of Decapping Characteristic>

Ink channels of a recording head of a shear mode type which is the same as that in "Evaluation of the maximum amount of push-out" were divided into three groups, and three-cycle driving was conducted under the following conditions, in the case of applying a meniscus fine vibrating waveform and in the case of applying no meniscus fine vibrating waveform. A meniscus fine vibrating waveform was applied repeatedly 217 times for a period of 50 ms from the moment of 220 ms before the start of ink jetting.

(Conditions)

Jetting drive signals: DRR waveform ($V_{on}/V_{off}=2/1$), $V_{on}=17.8$ V, $V_{off}=8.9$ V;

Ink: Aqueous pigment ink (Viscosity: 7.2 mPa·s, Surface tension: 34 mN/m at 25° C.);

Jetting drive: 4.8 μs pulse width×7AL cycle, 3 cycle drive; and

Ambient conditions: Temperature 12° C., Humidity 32% RH.

Incidentally, a drive signal shown in FIG. 4 was used for the meniscus fine vibrating waveform pulse, a pulse width was made to be $N_1=N_3=4$, and a pause period was to be $N_2=N_4=4$, and applying voltage was made to be the same as the aforesaid jetting drive signals in terms of voltage. The results are shown in FIG. 8.

As is clear from the drawing, when an ink meniscus fine vibrating waveform is not applied, the initial speed (6 m/s) is declined sharply to 2 m/s after the passage of 2s, but when the ink meniscus fine vibrating waveform is applied, the initial speed (6 m/s) is kept at 4.5 m/s even after the passage of 2s, thus, a great effect was observed on an improvement for decapping characteristic even under the low humidity environment, and stable jetting of initial ink droplet was confirmed.

As stated above, the invention makes it possible to provide an ink-jet recording apparatus wherein an effect of an improvement for decapping characteristic is high when ink in a nozzle is stirred efficiently prior to ink jetting, and an ink droplet can be jetted stably.

What is claimed is:

1. An ink-jet recording apparatus comprising:

a recording head having an ink channel and a nozzle; and an electromechanical converting device for changing a volume of the ink channel to cause an ink droplet to be jetted from the nozzle;

wherein before an ink droplet jetting operation is conducted and without jetting the ink droplet, an ink meniscus in the nozzle is vibrated finely by performing a plurality of times: (i) a pushing out process of pushing the ink meniscus out from a surface of the nozzle such that a peak distance of the ink meniscus from the surface of the nozzle is at least substantially equal to a radius of the nozzle, and (ii) a pulling process of pulling in the ink meniscus into the nozzle toward the ink channel past a repose position of the ink meniscus.

2. The ink-jet recording apparatus of claim 1, wherein drive signals are repeatedly applied a plurality of times to the electromechanical converting device to conduct the fine vibration of the ink meniscus, and said drive signals include: a voltage pulse with a pulse width of ($N_1$)AL for expanding the volume of the ink channel, a first pause period with a width of ($N_2$)AL, a voltage pulse with a pulse width of ($N_3$)AL for reducing the volume of the ink channel, and a second pause period with a width of ($N_4$)AL; where:

AL represents a half of an acoustical resonance period of the ink channel, each of $N_1$ and $N_3$ is an integer of at least 2 and each of $N_2$ and $N_4$ is a real number of at least 1.

3. The ink-jet recording apparatus of claim 1, wherein drive signals are repeatedly applied a plurality of times to the electromechanical converting device to conduct the fine vibration of the ink meniscus, and said drive signals include: a voltage pulse of rectangular wave with a pulse width of $(N_1)AL$ for expanding the volume of the ink channel, a first pause period with a width of $(N_2)AL$, a voltage pulse of rectangular wave with a pulse width of $(N_3)AL$ for reducing the volume of the ink channel, and a second pause period with a width of $(N_4)AL$; where:

AL represents a half of an acoustical resonance period of the ink channel, each of $N_1$ and $N_3$ is an integer of at least 2 and each of $N_2$ and $N_4$ is a real number of at least 1.

4. The ink-jet recording apparatus of claim 3, wherein each of $N_2$ and $N_4$ is an integer of at least 1.

5. The ink-jet recording apparatus of claim 3, wherein each of $N_1$, $N_2$, $N_3$ and $N_4$ is 4.

6. The ink-jet recording apparatus of claim 3, wherein a jetting drive voltage that causes the ink droplet to be jetted from the nozzle is equal to a fine vibration drive voltage that causes the ink meniscus to vibrate finely without causing the ink droplet to be jetted from the nozzle.

7. The ink-jet recording apparatus of claim 6, wherein when the recording head is outside an image recording area, an ink refreshing drive to spew ink is carried out by driving the electromechanical converting device, and wherein a jetting drive voltage for image recording, a fine vibrating drive voltage that causes the ink meniscus to vibrate finely, and an ink refreshing drive voltage are equal.

8. The ink-jet recording apparatus of claim 3, wherein the electromechanical converting device forms a partition wall between adjacent ink channels, and comprises a piezoelectric material that deforms in a shear mode.

9. The ink-jet recording apparatus of claim 1, wherein the peak distance of the ink meniscus from the nozzle is greater when the recording head is outside an image recording area, than when the recording head is on a non-recording pixel in the image recording area.

10. An ink-jet recording apparatus comprising:

a recording head having an ink channel and a nozzle; and an electromechanical converting device for changing a volume of the ink channel to cause an ink droplet to be jetted from the nozzle;

wherein drive signals are repeatedly applied a plurality of times to the electromechanical converting device to finely vibrate an ink meniscus without jetting an ink droplet from the nozzle, and said drive signals include: a voltage pulse with a pulse width of $(N_1)AL$ for expanding the volume of the ink channel, a first pause period with a width of $(N_2)AL$, a voltage pulse with a pulse width of $(N_3)AL$ for reducing the volume of the ink channel, and a second pause period with a width of $(N_4)AL$;

where:

each of $N_1$ and $N_3$ is an integer of at least 2, each of $N_2$ and $N_4$ is a real number of at least 1, and AL represents a half of an acoustical resonance period of the ink channel.

11. An ink-jet recording apparatus comprising:

a recording head having an ink channel and a nozzle; and an electromechanical converting device for changing a volume of the ink channel to cause an ink droplet to be jetted from the nozzle;

wherein drive signals are repeatedly applied a plurality of times to the electromechanical converting device to finely vibrate an ink meniscus without jetting an ink droplet from the nozzle, and said drive signals include: a voltage pulse of rectangular wave with a pulse width of $(N_1)AL$ for expanding the volume of the ink channel, a first pause period with a width of $(N_2)AL$, a voltage pulse with a pulse of rectangular wave width of $(N_3)AL$ for reducing the volume of the ink channel, and a second pause period with a width of $(N_4)AL$; where:

each of $N_1$ and $N_3$ is an integer of at least 2, each of $N_2$ and $N_4$ is a real number of at least 1, and AL represents a half of an acoustical resonance period of the ink channel.

12. The ink-jet recording apparatus of claim 11, wherein each of $N_3$ and $N_4$ is an integer of at least 1.

13. The ink-jet recording apparatus of claim 11, wherein each of $N_1$, $N_2$, $N_3$ and $N_4$ is 4.

14. The ink-jet recording apparatus of claim 11, wherein a jetting drive voltage that causes the ink droplet to be jetted from the nozzle is equal to a fine vibration drive voltage that causes the ink meniscus to vibrate finely without causing an ink droplet to be jetted from the nozzle.

15. The ink-jet recording apparatus of claim 14, wherein when the recording head is outside an image recording area, an ink refreshing drive to spew ink is carried out by driving the electromechanical converting device, and wherein a jetting drive voltage for image recording a fine vibrating drive voltage that causes the ink meniscus to vibrate finely, and a ink refreshing drive voltage are equal.

16. The ink-jet recording apparatus of claim 11, wherein the electromechanical converting device forms a partition wall between adjacent ink channels, and comprises a piezoelectric material that deforms in a shear mode.

17. An ink-jet recording apparatus comprising:

a recording head having an ink channel and a nozzle; and an electromechanical converting device for changing a volume of the ink channel to cause an ink droplet to be jetted from the nozzle;

wherein fine vibration of an ink meniscus in the nozzle is conducted without causing the ink droplet to be jetted, in which the ink meniscus is pushed out from a surface of the nozzle by a peak distance at least substantially equal to a nozzle radius.

18. The ink-jet recording apparatus of claim 17, wherein the peak distance is not more than three times the nozzle radius.

19. The ink-jet recording apparatus of claim 17, wherein drive signals are applied to the electromechanical converting device, said drive signals including: a voltage pulse of rectangular wave with a pulse width of $(N_1)AL$ for expanding the volume of the ink channel, a pause period with a width of $(N_2)AL$ and a voltage pulse of rectangular wave with a pulse width of $(N_3)AL$ for reducing the volume of the ink channel; where:

each of $N_1$, $N_2$ and $N_3$ is an integer of at least 2, and

AL represents a half of an acoustical resonance period of the ink channel.

20. The ink-jet recording apparatus of claim 17, wherein a jetting drive voltage that causes an ink droplet to be jetted from the nozzle, a fine vibration drive voltage that causes the ink meniscus to vibrate finely without causing an ink droplet to be jetted from the nozzle, and an ink refreshing drive voltage that causes ink to spew outside an image recording area are equal.

21. The ink-jet recording apparatus of claim 17, wherein the peak distance of the ink meniscus from the nozzle is greater when the recording head is outside an image recording area than when the recording head is on a non-recording pixel in the image recording area.

22. The ink-jet recording apparatus of claim 17, wherein the electromechanical converting device forms a partition wall between the adjacent ink channels, and comprises a piezoelectric material that deforms in a shear mode.

* * * * *